US007606508B2

(12) United States Patent
Tsukamura et al.

(10) Patent No.: US 7,606,508 B2
(45) Date of Patent: Oct. 20, 2009

(54) IMAGE FORMING APPARATUS WITH A FIXING APPARATUS

(75) Inventors: Shinichi Tsukamura, Hino (JP); Takayuki Horie, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 248 days.

(21) Appl. No.: 11/785,360

(22) Filed: Apr. 17, 2007

(65) Prior Publication Data

US 2008/0003006 A1 Jan. 3, 2008

(30) Foreign Application Priority Data

Jun. 29, 2006 (JP) ..... 2006-179206

(51) Int. Cl.
*G03G 15/20* (2006.01)

(52) U.S. Cl. ..... 399/67; 399/328; 399/329

(58) Field of Classification Search ..... 399/38, 399/67, 68, 107, 122, 320, 328, 329; 219/216
See application file for complete search history.

(56) References Cited

U.S. PATENT DOCUMENTS 7,024,145 B2 * 4/2006 Aruga et al. ..... 399/329
7,167,670 B2 * 1/2007 Obata et al. ..... 399/329
7,398,045 B2 * 7/2008 Uehara et al. ..... 399/329

* cited by examiner

*Primary Examiner*—Hoan H Tran
(74) *Attorney, Agent, or Firm*—Finnegan, Henderson, Farabow, Garrett & Dunner, L.L.P.

(57) ABSTRACT

An image forming apparatus including a fixing roller; an endless fixing belt rotated together with the fixing roller; a pressurizing section arranged on the inner peripheral surface side of the fixing belt wherein the pressurizing section makes the fixing belt to be in pressure contact with the fixing roller, and corresponding to the outer peripheral surface of the fixing roller, the pressurizing section is deformed into a concave shape; a separation section which makes the fixing belt to be in pressure contact with the fixing roller, and by a tip of the separation section, the outer peripheral surface of the fixing roller is deformed into a concave shape; and a controller for controlling the pressing force of the separation section so that when an envelope is passed through as the recording material the pressing force becomes stronger than the pressing force when a plain paper passes through as the recording material.

10 Claims, 5 Drawing Sheets

IMAGE FORMING APPARATUS WITH A FIXING APPARATUS

BACKGROUND OF THE INVENTION

The present invention relates to a copier, printer, facsimile, and to a control of a fixing apparatus used for an electrophotographic type image forming apparatus such as a complex machine provided with these functions, and particularly, to a fixing apparatus for heating, pressuring and fixing a toner image formed in a recording material in a nip portion formed between a fixing roller and an endless fixing belt, and to an image forming apparatus provided with the fixing apparatus by which a wrinkle is not generated even when an envelope is passed through.

In the electro photographic type image forming apparatus such as the complex machine provided with the copier, printer, facsimile, and these functions, a latent image corresponding to a document is formed on a photoreceptor drum and visualized when the toner is given to this latent image, and this visualized toner image is transferred onto the recording material, and after that, the toner image on the recording material is fixed and sheet-delivered.

Further, when a color image is formed, the latent image of Y, M, C, K corresponding to a document color is formed on the 4 photoreceptor drums, and after the visualized 4 color toner images are primarily transferred onto the endless inter mediate transfer belt, secondarily transferred onto the recording material and the toner image transferred onto the recording material is fixed and sheet-delivered.

As the fixing apparatus for fixing the toner image in such a manner, there is the fixing apparatus of the heat roller fixing system by which while the recording material onto which the toner image is transferred is nipped and conveyed by a fixing roller in which a heating means such as a halogen lamp is housed, and a nip portion formed by a pressure roller for pressing the fixing roller, it is heated and pressed, and because, in such a fixing apparatus, the structure is simple, it is widely used.

Hereupon, in such a fixing apparatus, in order to intend the high speeding-up, it is necessary that enough heat amount is supplied to the toner and the recording material, therefore, it is necessary that the nip width is widened. In order to widen the nip-width, it is considered to increase the pressing force which the pressing roller presses the fixing roller, the thickness of the elastic layer formed of silicon rubber in the pressing roller, or the diameter of two rollers.

However, when the pressing force or the thickness of the elastic layer is increased, there is a case where the nip width in the axial direction becomes un-uniform, and there is a possibility that uneven fixing, or a wrinkle of recording material is generated. Further, when the diameter of the roller is increased, there is a problem that not only a case where the size of the fixing apparatus is increased, but also a warming-up time is extended.

In order to solve this problem, the fixing apparatus which is provided with the fixing roller which has the elastic layer formed of silicon rubber, and the heating means such as a halogen lamp is housed in the center, and rotated, the endless fixing belt which is driven by the fixing roller and rotated, and an elastic pressing member arranged inner peripheral surface side of the fixing belt, and by the elastic pressing member, which pressure-contacts the fixing belt with the fixing roller, is disclosed in Tokkai No. 2005-173441.

According to this fixing apparatus, the fixing belt which is in pressure contacted with the fixing roller by the elastic pressing member is elastic deformed, the wide nip portion is formed between the fixing roller and the fixing belt. Accordingly, it can correspond to the high speeding-up and the size of the fixing apparatus is not increased. Further, because the heat capacity of the fixing belt is small, the warming-up time is reduced, and the energy saving is attained.

Herein, as the recording material to be passed through, excepting the sheet which is only one sheet such as the plain paper, there is a case where an envelope is used. When the envelope is used, because both ends of the sheet material are fixed, and 2 sheets are superimposed between them, when the envelope passes through the circular arc-likely formed nip portion, the sheet material positioned on the fixing roller side is positioned in the inside of the circular arc, the sheet material positioned on the fixing belt side is positioned on the outside of the circular arc, and the conveyance speed of the latter one is faster than the former one, and because the conveyance speed of the both are different, the wrinkle is easily generated in the latter one.

For this reason, in the fixing apparatus in the same manner as the fixing apparatus written in Japanese Patent Publication Open to Public Inspection No. 2005-173441, in the case of envelope mode in which the envelope is passed through, the fixing apparatus in which the contact-pressing force of the elastic pressing member is reduced, and the generation of wrinkle is prevented, is disclosed in Japanese Patent Publication Open to Public Inspection No. 10-228200.

However, in the fixing apparatus written in Japanese Patent Publication Open to Public Inspection No. 10-228200, when the envelope is passed through, although the generation of the wrinkle can be prevented, when the contact-pressing force of the elastic pressing member is decreased, the fixing property is deteriorated. In order to prevent the deterioration of the fixing property, it may be allowable when the conveyance speed of the envelope is decreased, however, the number of output sheets per unit time is decreased, and a problem that the productivity is decreased, is generated.

SUMMARY

The present invention has been made in view of such a problem, and the object of the present invention is to propose the image forming apparatus in which when the envelope is fixed, the wrinkle is not generated, and it is also not necessary that the number of output sheets per unit time is reduced.

One aspect of the invention is: an image forming apparatus comprising: a fixing roller having a heating section which is rotated; an endless fixing belt which is rotated together with the fixing roller; a pressurizing section which is arranged on the inner peripheral surface side of the fixing belt, wherein the pressurizing section makes the fixing belt to be in pressure contact with the fixing roller by pressing the fixing belt, and corresponding to the outer peripheral surface of the fixing roller, the pressurizing section is deformed into a concave shape together with the fixing belt, wherein the pressurizing section forms a first nip portion between the fixing roller and the fixing belt; a separation section which is arranged downstream of the pressurizing section in a conveyance direction of a recording material and arranged in the inner peripheral surface side of the fixing belt, and the separation section makes the fixing belt to be in pressure contact with the fixing roller by pressing the fixing belt, and by a tip of the separation section, the outer peripheral surface of the fixing roller is deformed into a concave shape, wherein the separation section forms a second nip portion between the fixing roller and the fixing belt, a toner image on a recording material being fixed at the first nip portion and the second nip portion, and a controller for controlling the pressing force of the separation section so that when an envelope is passed through as the recording material the pressing force becomes stronger than the pressing force when a plain paper passes through as the recording material.

DESCRIPTION OF PREFERRED EMBODIMENT

Figure 1:
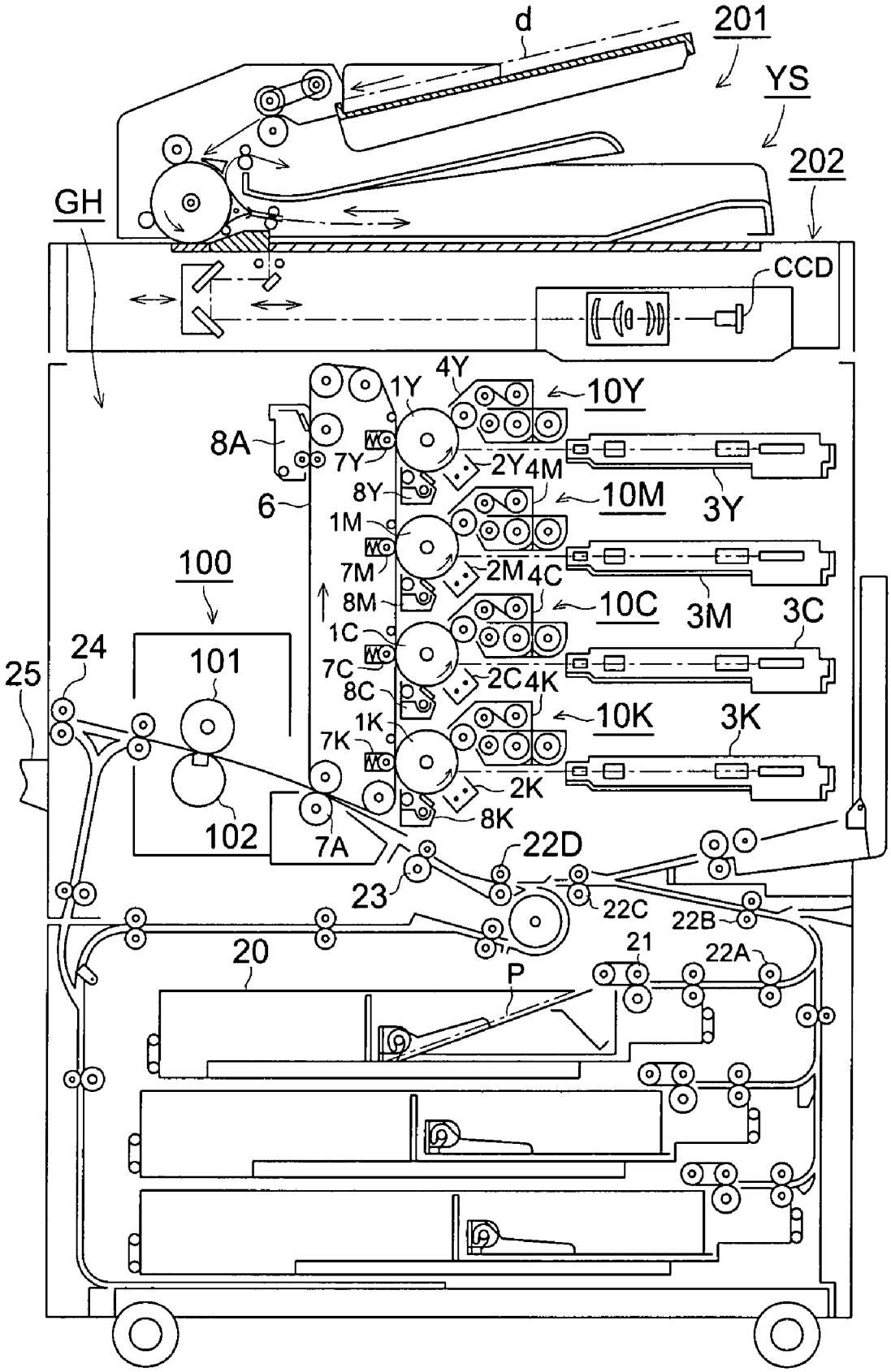
FIG. 1 is a structural view of an image forming apparatus.

Referring to the drawing, the embodiment relating to an image forming apparatus of the present invention will be described below.

Initially, based on the structural view of FIG. 1, an example of the image forming apparatus will be described.

The present image forming apparatus is structured by the image forming apparatus main body GH and an image reading apparatus YS.

The image forming apparatus main body GH is called a tandem type color image forming apparatus, and structured by a plurality of sets of the image forming sections 10Y, 10M, 10C, 10K, a belt-like intermediate transfer body 6, feeding sheet passing sheet section and the fixing apparatus 9.

On the upper part of the image forming apparatus main body GH, the image reading apparatus YS composed of an automatic document feeding apparatus 201 and a document image scanning and exposing apparatus 202 is arranged. The document d placed on a platen of the automatic document feeding apparatus 201 is passed through by the passing sheet section, and by an optical system of the document image scanning and exposing apparatus 202, the image of a single surface or double surfaces of the document is scanned and exposed, and read in a line image sensor CCD.

A signal which is photo-electrically converted and formed by the line image sensor CCD is, after in an image processing section, analog processing, A/D conversion, shading correction, and an image compression processing are conducted, sent to the exposing sections 3Y, 3M, 3C, 3K.

The image forming section 10Y for forming the yellow (Y) image arranges a charging section 2Y, exposing section 3Y, developing section 4Y and cleaning section 8Y around the photoreceptor drum 1Y. The image forming section 10 M for forming magenta (M) image arranges the charging section 2M, exposing section 3M, developing section 4M and cleaning section 8M around the photoreceptor drum 1M. The image forming section 10C for forming cyan (C) image arranges the charging section 2C, exposing section 3C, developing section 4C and cleaning section 8C, around the photoreceptor drum 1C. The image forming section 10K for forming black (K) image arranges the charging section 2K, exposing section 3K, developing section 4K and cleaning section 8K around the photoreceptor drum 1K. Then, the charging section 2Y and the exposing section 3Y, charging section 2M and exposing section 3M, charging section 2C and exposing section 3C, and charging section 2K and exposing section 3K, structure a latent image forming section.

Hereupon, the developing sections 4Y, 4M, 4C, 4K contain the 2-component developing agent composing of toners of yellow (Y), magenta (M), cyan (C), and black (K) and carrier.

The intermediate transfer body 6 is wound by a plurality of rollers, and rotatably supported.

The fixing apparatus 100 heats and presses the toner image on the recording sheet (recording material) P by the nip portion formed between the heated fixing roller 101 and the fixing belt 102, and fixes.

In such a manner, the images of each color formed by the image forming sections 10Y, 10M, 10C, 10K, are successively transferred (primary transfer) onto rotating intermediate transfer body 6, by the transfer sections 7Y, 7M, 7C, 7K, and the toner image which is compounded by color images, is formed. The recording sheet P accommodated in the sheet feeding cassette 20 is fed by the sheet feeding section 21, and via sheet feeding rollers 22A, 22B, 22C, 22D, register roller 23, passed through to the transfer section 7A, and the color image is transferred onto the recording sheet P (secondary transfer). The recording sheet P onto which the color image is transferred, is heated and pressed in the fixing apparatus 100, and the color toner image on the recording sheet P is fixed. After that, it is nipped by the delivery sheet roller 24 and placed on the delivery sheet tray 25 outside the apparatus.

On the one hand, after the color image is transferred onto the recording sheet P by the transfer section 7A, on the intermediate transfer body 6 from which the recording sheet P is curvature-separated, the residual toner is removed by the cleaning section 8A.

Hereupon, the above description is the image forming apparatus which forms the color image, however, it may also be the image forming apparatus which forms the monochromatic image, and the intermediate transfer body may be used or not used.

Figure 2:
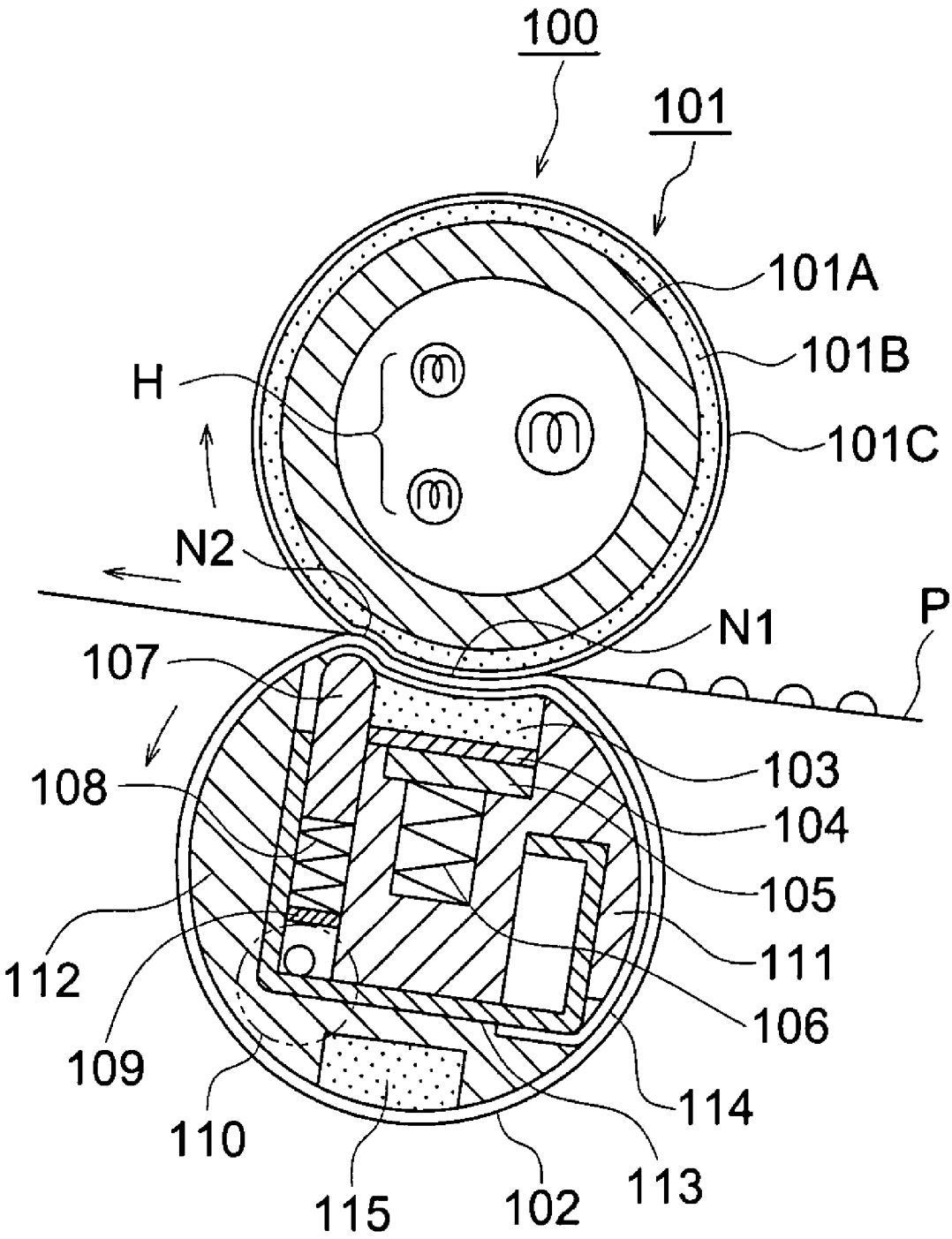
FIG. 2 is a sectional view of a fixing apparatus.

Next, the main structure of the fixing apparatus 100 according to the present invention will be described based on the sectional view of the fixing apparatus which is orthogonal to the central axis shown in FIG. 2, and cut.

The fixing roller 101 houses a halogen lamp (heating means) H in the center, and is structured by the elastic layer 101B formed of the silicon rubber which sheathes the cylindrical core metal 101A formed of aluminum or iron, and the heat resistance is high, and further, the mold-releasing layer 101C which sheathes the elastic layer 101B, and formed of fluorine resin such as PFA (perfluoro arkoxy) or PTFE (polytetra fluoro-ethylene).

The fixing belt 102 is structured by the substratum formed of polyimide whose thickness is about 100 μm and the mold-releasing layer formed of PFA or PTFE which sheathes the outer surface of the substrate and whose thickness is about 25 μm, and formed into endless.

The pressing pad 103 is formed of silicon rubber whose hardness is JISA about 10°, and arranged on inner peripheral surface side of the fixing belt 102, and together with the base steel plate 104 formed of stainless steel and the base member 105 formed of heat resistant resin, held by the holder 111 formed of the heat resistant resin. Further, the compression spring 106 (pressing member) is arranged on the rear surface of the base member 105, and presses the pressing pad 103 through the base steel plate 104 and the base member 105.

Herein, including the pressing pad 103, base steel plate 104, base member 105, and compression spring 106, they are called pressing means.

The separation member 107 is structured as a member different from the pressuring pad, for example, formed of the heat resistant resin or metal such as aluminum, and arranged on the inner peripheral surface side of the fixing belt 102 and by a pressuring pad 103, on the downstream side of the conveyance direction of the recording sheet P, and held by the holder 111 and metallic frame 113 arranged in the center.

Then, with the trailing edge of the separation member, one end of the compression spring 108 (pressure member) which is another member from the compression spring 106 is in contact, and the other end of the compression spring 108 is in contact with the metallic base steel plate 109. The base steel plate 109 is extended longer than the fixing belt 102 on both ends of the central axis direction of the fixing belt 102, and with both end parts of the base steel plate 109 of the same direction, the eccentric cam 110 is in contact.

Herein, the separation member 107 and the compression spring 108 are called separation section.

The sliding move member 114 is formed of Teflon (registration trade mark) coating glass fiber sheet or PTFE sheet, and arranged between the inner peripheral surface of the fixing belt 102, and the pressuring pad 103, and the inner peripheral surface of the fixing belt 102 and the separation member 107, and one end is fixed to the frame 113.

The oil pad 115 is formed of a sponge, and contains the lubrication agent formed of silicon oil, held by the holder 112 formed of heat resistant resin, and pressed to the inner peripheral surface of the fixing belt 102.

Hereupon, when the fixing belt 102 is rotated, the holder 111 has also a function which guides the fixing belt 102 through the sliding move member 114, and the holder 112 has also a function which directly guides the fixing belt 102.

Then, the holders 111, 112 are held by the frame 113.

In the fixing apparatus 100 structured in such a manner, the fixing roller 101 heated by the halogen lamp H and driven by the drive section, not shown, is rotated clockwise. Further, the base steel plate 104 and the pressing pad 103 pressed through the base member 105 by the compression spring 106 are pressure contacted by the fixing belt 102 with the fixing roller 101 through the sliding move member 111. Further, the separation member 107 pressed by the compression spring 108 pressure contacts the fixing belt 102 with the fixing roller 101 through the sliding move member 111.

Accordingly, the fixing belt 102 is rotated counter clockwise by the rotation of the fixing roller 101.

Herein, the pressuring pad 103 pressure contacts the fixing belt 102 with the fixing roller 101, however, because the pressuring pad 103 is softer than the fixing roller 101, the pressuring pad 103 is elastic deformed into concave shape together with the fixing belt 102 corresponding to the outer peripheral surface of the fixing roller 101. In this manner, the wide first nip portion N1 is formed between the fixing belt 102 and the fixing roller 101.

Further, the separation member 107 pressure contacts the fixing belt 102 with the fixing roller 101, however, because the fixing roller 101 is softer than the separation member 107, the outer peripheral surface of the fixing roller 101 is elastic deformed into concave shape corresponding to the leading edge part of the separation member 107. In this manner, the second nip portion is formed between the fixing roller 101 and the fixing belt 102.

As this result, in the first nip portion N1, the curvature center is positioned on the side of the fixing roller 101, and the first nip portion N1 is curved with the small curvature, and in the second nip portion N2, the curvature center is positioned on the inner peripheral surface side of the fixing belt 102, and the second nip portion N2 is curved with the large curvature.

Hereupon, because the second nip portion N2 is a part for improving the reparability when the recording sheet P is separated from the fixing roller 101, its width is smaller than the first nip portion N1, and the inflection point formed by the first nip portion N1 and the second nip portion N2 is positioned on the downstream side in the conveyance direction of the recording sheet P from the central position of the entire nip portion in which the first nip portion N1 and the second nip portion N2 is connected. In this manner, the unfixed toner on the conveyed recording sheet P is heated pressed and fixed in the first nip portion N1 and the second nip portion N2, and is securely separated from the fixing roller 101 and delivered.

Hereupon, because the inner peripheral surface of the fixing belt 102 sliding moves on the sliding move member 111 whose friction coefficient is small at the time of rotating, the friction resistance between the both is small, and because from the oil pad 115, the silicon oil as the lubrication agent is supplied to the inner peripheral surface of the fixing belt 102, further, the sliding move resistance is small.

In the fixing apparatus structured as described above, not only the toner image transferred onto the plain paper is fixed, there is a case where the toner image transferred onto the envelope is fixed. When the envelope is passed through under the condition shown in FIG. 2, in the first nip portion N1, the sheet material of the rear side of the envelope which contacts with the fixing belt 102 is conveyed at faster speed than the sheet material of the front side which contacts with the fixing roller 101. On the one hand, in the second nip portion N2, inversely, the sheet material of the front side of the envelope is conveyed faster than the sheet material of the rear side. Because the nip width of the second nip portion N2 is narrower than the first nip portion N1, as the entire nip, the sheet material of the rear side of the envelope is conveyed at the faster speed, the wrinkle is easily generated on the sheet material of the rear side.

Hereupon, when width of the second nip portion N2 is increased and makes almost equal to the first nip portion, the wrinkle is not generated even when the envelope is passed through, however, the curvature of the second nip portion N2 becomes small, and the separability from the fixing roller 101 is lowered.

Figure 3:
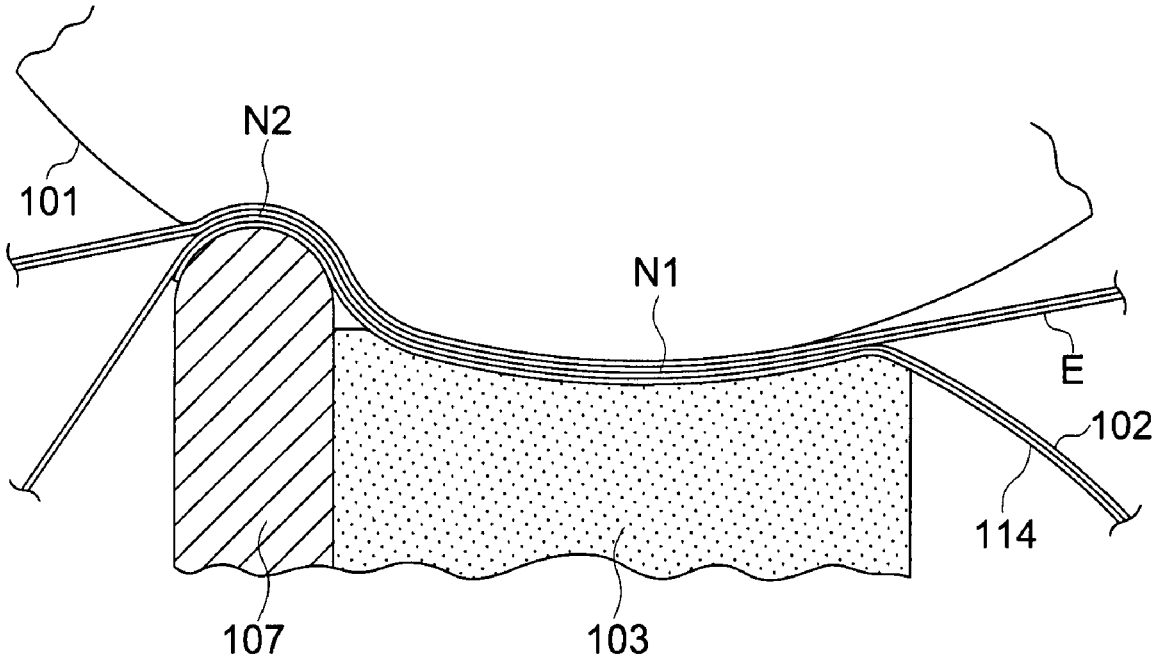
FIG. 3 is an enlarged sectional view of a nip portion.

Therefore, as shown in enlarged sectional view of the nip portion of FIG. 3, when the envelope E is passed through, the pressing force of the separation member 107 is more increased, the fixing belt 102 is pressure contacted with the fixing roller strongly, the outer peripheral surface of the fixing roller 101 is more deformed by the leading edge part of the separation member 107, and when the curvature of the second nip member N2 is made larger, because in the second nip portion N2, the sheet material of the front side of the envelope is conveyed at faster speed than the sheet material of the rear side, the speed difference of the front and the rear generated in the first nip portion N1 is eliminated, and as the entire nip, the speed of the sheet material of the front side of the envelope E and the speed of the sheet material of the rear side become equal, the wrinkle is not generated.

Hereupon, when structured in this manner, the direction in which the envelope E enters into the first nip portion N1, and the direction in which delivered from the second nip portion N2 become almost equal.

On the one hand, when the plain paper is passed through, the pressing force of the separation member 107 is not increased as described above, but remains in the degree the plain paper can be normally separated. This is from the reason that, in the case where the plain paper is passed through, when the pressing force of the separation member 107 is increased, because the curvature of the second nip portion N2 is more increased, the curling is easily generated in the fixed plain paper. Hereupon, because the thickness of the sheet is comparatively thick in the case of the envelope, even when the curvature of the second nip portion N2 is more increased, it is difficult that the curling is generated.

Figure 5:
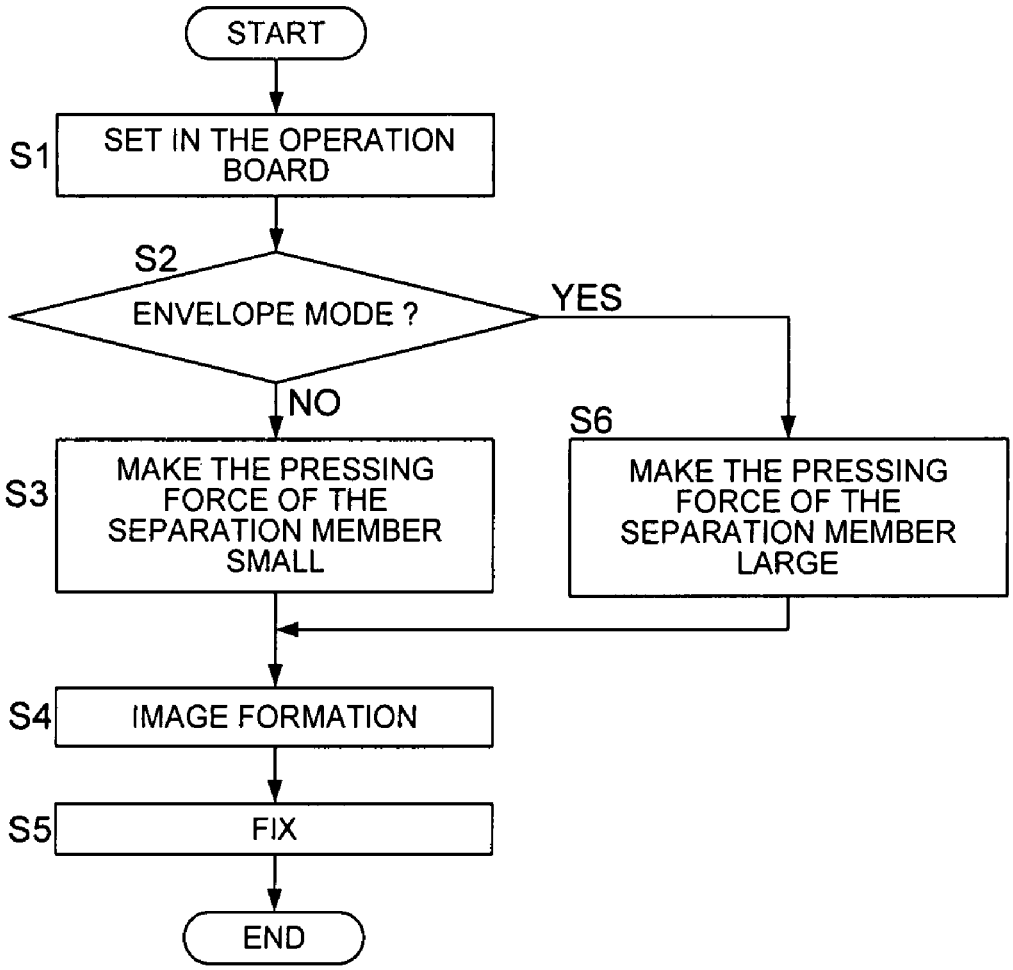
FIG. 5 is a flow chart according to the present invention.
Figure 6:
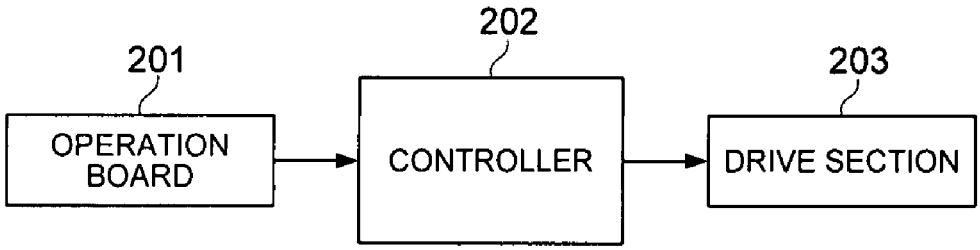
FIG. 6 is a block diagram according to the present invention.

Next, the structure in which pressing force of the separation member 107 is changed when the plain paper is fed, and when the envelope is fed, based on the sectional view of the fixing apparatus of FIG. 4, flow chart of FIG. 5, block diagram of FIG. 6, will be described.

Initially, in the operation board 201 of the image forming apparatus, any one of mode in which the plain paper is passed through, or the envelope is passed through is selected and set (S1).

In the case of the plain paper mode in which the plain paper is passed through (N of S2), the controller 202 composed of CPU does not drive the drive section 203 composed of motor, solenoid. Accordingly, under the condition (S3) shown in FIG. 2, that the pressing force of the separation member 107 is small, the image formation is conducted (S4), and the toner image transferred onto the plain paper is fixed (S5).

Figure 4:
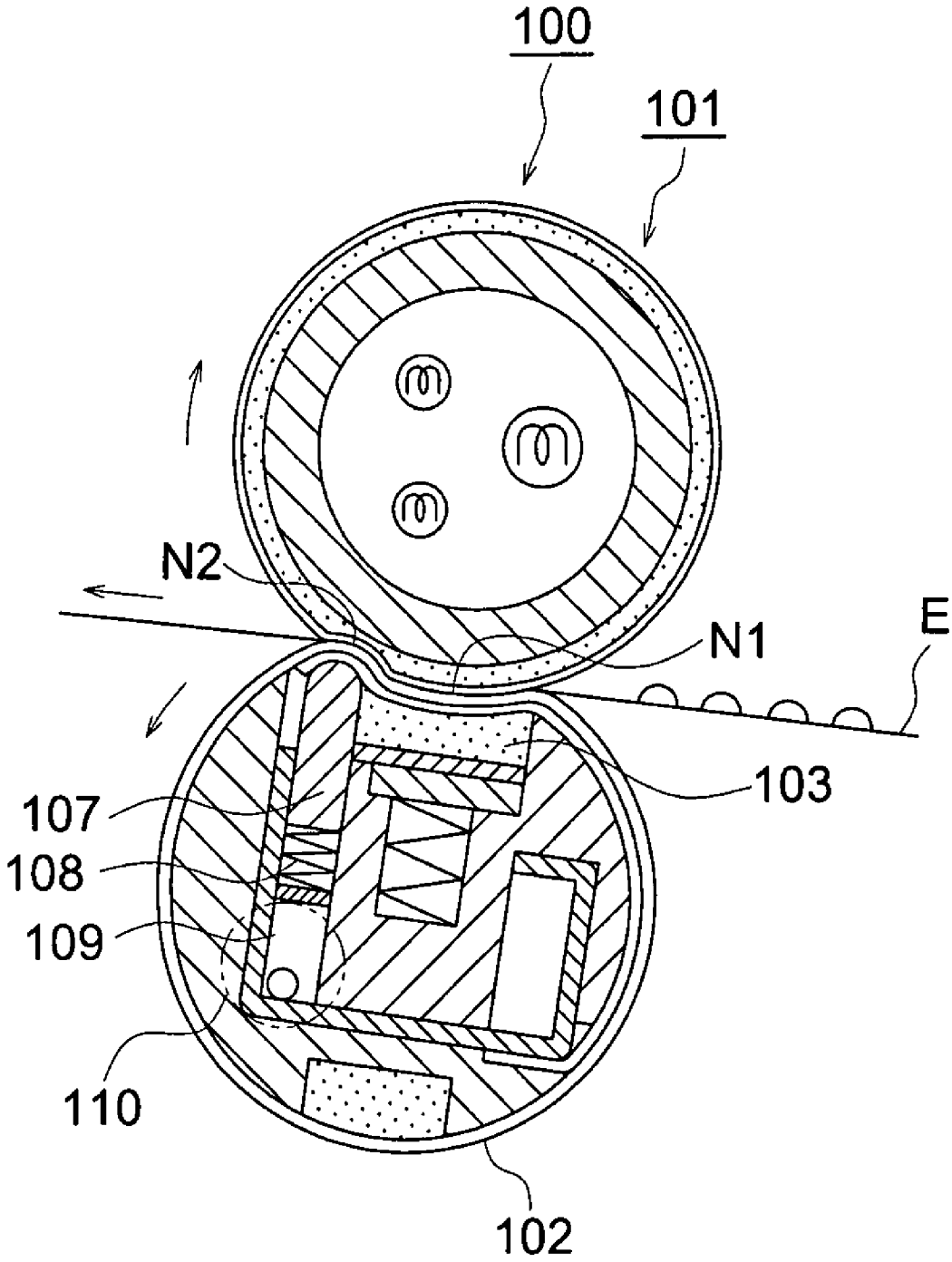
FIG. 4 is a sectional view of the fixing apparatus in which the pressing force of a separation member is increased.

On the one hand, in the case of the envelope mode in which the envelope is passed through (Y of S2), the controller 202 drives the drive section 203, rotates the eccentric cam 110 shown in FIG. 4, and compresses the compression spring 108 through the base steel plate 109. Accordingly, the pressing force of the separation member 107 is increased (S6), under the condition that the curvature of the second nip portion N2 is more increased, the image formation is conducted (S4), and the toner image transferred onto the envelope is fixed (S5).

Hereupon, the plain paper mode or the envelope mode is not input-operated in the operation board, the thickness of sheet of the fed recording material may be detected by a pressure sensor, and the plain paper mode or the envelope mode may also be automatically discriminated.

Next, the experiment relating to the generation of the wrinkle when the envelope is passed through by using the fixing apparatus structured as described above, will be shown.

(1) Experimental Conditions fixing roller: diameter 40 mm, rubber thickness 1.0 mm, rubber hardness 10° (JIS-A)

fixing belt: diameter 35 mm, thickness 100 μm, the material poly imide nip portion by the pressing pad (first nip portion): nip width 8 mm, pressure 50 kpa nip portion by the separation member (second nip portion): nip width 2.5 mm pressing force of the separation member (weight): 150 N, 230 N recording material: envelope length 120 mm×235 mm, weight 100 gsm, white (2) Result of Experiment shown in Table 1.

TABLE 1

| Separation member weight | Wrinkle is generated |
|---|---|
| 150 N | YES |
| 230 N | NO |

(3) Consideration

In the case of the pressing force of 150 N, the depth of the concave part of the fixing roller which is pressed and deformed by the separation member is shallow, because the speed difference of the sheet material of the front and rear of the envelope generated in the first nip portion is not eliminated in the second nip portion, the wrinkle is generated in the sheet material of the rear side of the envelope (fixing belt side).

In the case of the pressing force of 230 N, the depth of the concave part of the fixing roller which is pressed and deformed by the separation member is adequate, and because the speed difference of the sheet material of the front and rear of the envelope generated in the first nip portion is eliminated in the second nip portion, the wrinkle is not generated.

According to the image forming apparatus of the present invention as described above, the wrinkle is not generated when the envelope is fixed, and there is an effect that it is not also necessary that the output number of sheets per unit time is decreased. Hereupon, the pressing force for pressing the above-described separation member is a value in the case of the fixing apparatus of the above-described condition, when the conditions of the fixing apparatus are different, the pressing force is also different. Accordingly, it is necessary that the adequate pressing force is previously found by the experiment corresponding to the fixing apparatus.

What is claimed is:

1. An image forming apparatus, comprising:

a fixing roller having a rotating heating section;

an endless fixing belt rotated together with the fixing roller;

a pressurizing section arranged on an inner peripheral surface side of the fixing belt, wherein the pressurizing section presses the fixing belt for being in pressure contact with the fixing roller, and corresponding to an outer peripheral surface of the fixing roller, the pressurizing section is deformed into a concave shape together with the fixing belt, wherein the pressurizing section forms a first nip portion between the fixing roller and the fixing belt;

a separation section arranged downstream of the pressurizing section in a conveyance direction of a recording material and arranged in the inner peripheral surface side of the fixing belt, wherein the separation section presses the fixing belt for being in pressure contact with the fixing roller wherein by a tip of the separation section, the outer peripheral surface of the fixing roller is deformed into a concave shape, wherein the separation section forms a second nip portion between the fixing roller and the fixing belt, and wherein a toner image on the recording material is fixed at the first nip portion and the second nip portion; and a controller for controlling a pressing force of the separation section so that when an envelope is passed through as the recording material the pressing force becomes stronger than the pressing force when a plain paper passes through as the recording material.

2. The image forming apparatus of claim 1, wherein a speed difference between a conveying speed of a front side sheet of the envelope and a conveying speed of a rear side sheet of the envelope, generated when the envelope is passed through the first nip portion, is eliminated when the envelope passes through the second nip portion.

3. The image forming apparatus of claim 1, wherein when the envelope is passed through, the pressing force of the separation section is set so that a direction in which the envelope enters into the first nip portion and a direction in which the envelope is delivered from the second nip portion becomes almost equal.

4. The image forming apparatus of claim 1, wherein an inflection point formed by connecting the first nip portion and the second nip portion is positioned on the downstream side in the conveyance direction of the recording sheet from a central position of an entire nip portion that includes the first nip portion and the second nip portion.

5. The image forming apparatus of claim 1, wherein the pressurizing section presses the fixing roller with a pressuring member and the separation section presses the fixing roller with a separation member.

6. The image forming apparatus of claim 5, wherein the pressuring member is structured as a member different from the separation member.

7. The image forming apparatus of claim 5, wherein the pressuring member is pressed by a first pressure member and the separation member is pressed by a second pressure member.

8. The image forming apparatus of claim 5, wherein the separation section includes a drive section for changing the pressing force against the fixing roller.

9. The image forming apparatus of claim 8, wherein the separation section changes the pressing force by rotating an eccentric cam with the drive section.

10. The image forming apparatus of claim 5, wherein the pressuring member is a pressing pad.

* * * * *